US006305542B1

(12) United States Patent
Barbrow

(10) Patent No.: US 6,305,542 B1
(45) Date of Patent: Oct. 23, 2001

(54) COMPACT ORGANIZER FOR OPEN-END WRENCHES

(76) Inventor: Larry Warren Barbrow, P.O. Box 1215, Chilhowie, VA (US) 24319

( * ) Notice: Subject to any disclaimer, the term of this patent is extended or adjusted under 35 U.S.C. 154(b) by 0 days.

(21) Appl. No.: 09/497,990

(22) Filed: Feb. 4, 2000

Related U.S. Application Data

(60) Provisional application No. 60/119,153, filed on Feb. 8, 1999.

(51) Int. Cl.[7] ..... B65D 85/28

(52) U.S. Cl. ..... 206/376; 206/375; 206/493; 211/70.6

(58) Field of Search ..... 206/375–378, 206/372, 493; 211/7, 70.6

(56) References Cited

U.S. PATENT DOCUMENTS 1,750,011 * 3/1930 Kneier ..... 206/375
2,068,308 * 1/1937 Zerver ..... 206/376
2,465,290 * 3/1949 Sorenson ..... 206/376
4,497,405 * 2/1985 Mikic et al. ..... 206/378
4,997,085 * 3/1991 Brennan ..... 206/376
5,020,666 * 6/1991 Barlean ..... 206/376
5,139,144 * 8/1992 Robert, Jr. ..... 206/378

* cited by examiner

*Primary Examiner*—Bryon P. Gehman

(57) ABSTRACT

A compact organizer for open-end type wrenches includes a plurality of different sized rubber washers mounted and retained on a support rod. The opening in the head of a wrench is reasonably forced onto a corresponding rubber washer, compressing the rubber washer and causing it to grip the opening in the wrench. The set of wrenches are held parallel to and butted up against one another, therefore requiring a minimal amount of storage space.

1 Claim, 3 Drawing Sheets

COMPACT ORGANIZER FOR OPEN-END WRENCHES

CROSS-REFERENCE TO RELATED APPLICATIONS

This Application claims benefit of Provisional No. 60/119,153 filed Feb. 8, 1999.

BACKGROUND OF THE INVENTION

This invention relates to an organizer for storing a set of open-end type wrenches in a very compact and easily accessible manner.

Any person attempting to perform a considerable amount of service on modem day equipment is finding the need to have a multitude of both basic and special tools to complete their work. Storage and organization of these tools is now becoming crucial to efficient performance of their tasks. Prior wrench holders generally rely on a means of gripping the handles or some external surface of the wrench. Rack type wrench holders provide a well-organized distribution of the wrenches while generally providing a carrying handle. This method is a disadvantage if space is an issue. Some wrench holders are made to hold the wrenches in stacked form with the holding member gripping the complete set of wrenches. This can be a disadvantage, when only one or two wrenches are removed from the set, since incidental contact of the remaining wrenches can disturb their arrangement.

BRIEF SUMMARY OF THE INVENTION

This invention is directed to a holder and more particularly a compact organizer for open-end type wrenches. The object of the present invention is to hold a set of progressively different sized open-end type wrenches in an organized and compact arrangement. The set of wrenches can then be stored on a workbench or in a tool chest drawer. When the need arises to use an individual wrench in the set, the wrench can be easily identified, removed, used and then replaced on the invention.

A compact organizer for open-end type wrenches comprises a series of progressively different sized rubber washers, with a support rod placed through the center of all rubber washers and retainers placed on each end of the support rod. Each rubber washer of the invention is sized to grip the inside jaw surface of the opening of the head of the respective wrench that it holds.

By gripping the inside area of the head of each wrench in a set, the problem of removing a wrench from the set and the space required during storage is greatly reduced.

DETAILED DESCRIPTION OF THE INVENTION

Figure 1:
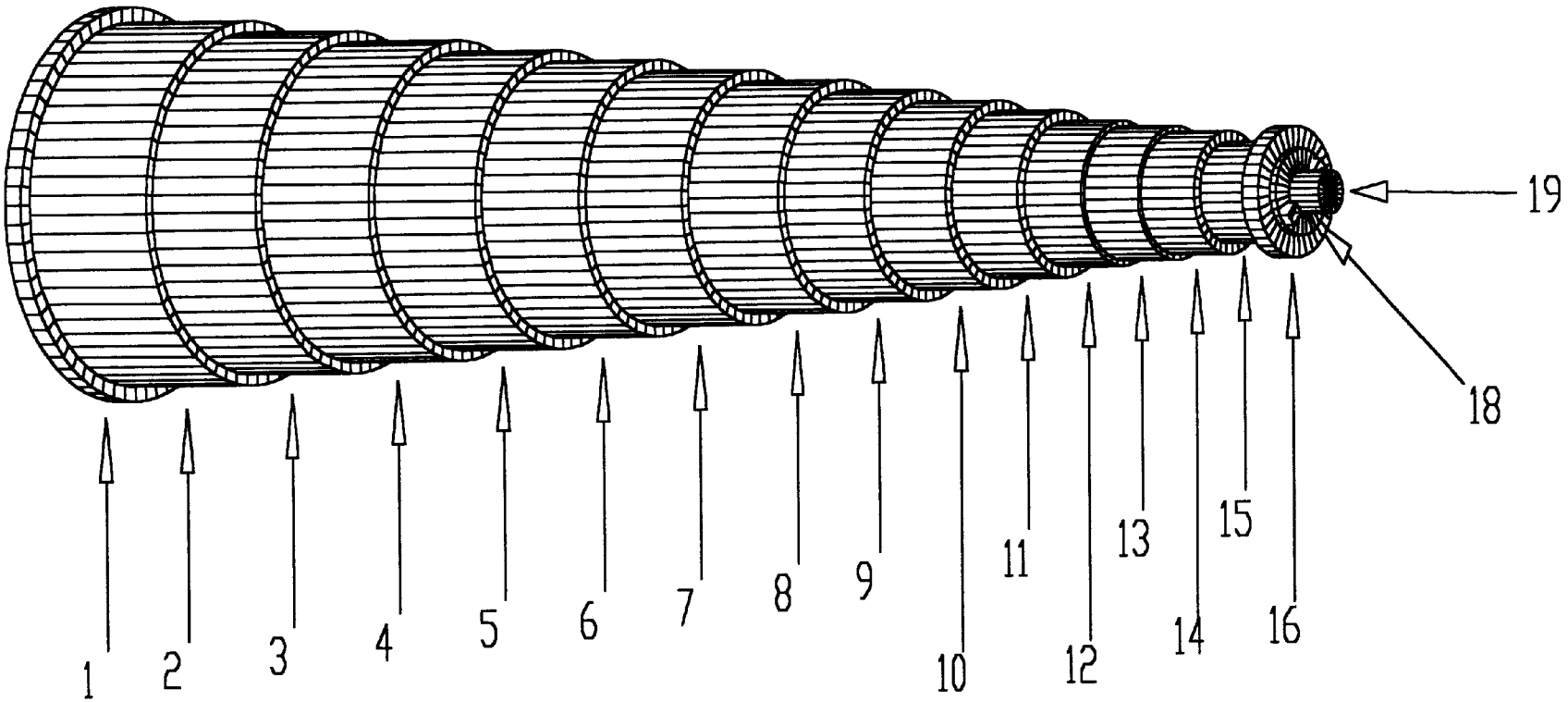
FIG. 1 is a perspective view of a compact organizer for open-end type wrenches in accordance with the present invention.

As shown in FIG. 1 a compact organizer for open-end type wrenches of the present invention comprises a series of progressively different sized rubber washers 2 through 15, arranged in descending order, with each successive rubber washer being placed flat against and centered with the previous rubber washer. A thin rigid washer 1, which has an outside diameter slightly greater than the largest rubber washer 2, is placed flat against and centered with the largest rubber washer 2, so that when a wrench is placed on the largest rubber washer 2, the wrench cannot come off of the end of the invention. A thin rigid washer 16, which has an outside diameter slightly greater than the smallest rubber washer 15, is placed flat against and centered with the smallest rubber washer 15, so that when a wrench is placed on the smallest rubber washer 15, the wrench cannot come off of the end of the invention. A round support rod 19 is inserted through all of the washers 1, 2 through 15, and 16. A retainer 18 is fastened on each end of the round support rod 19 to hold all washers 1, 2 through 15, and 16 flat against each other and to hold the invention together.

Figure 2:
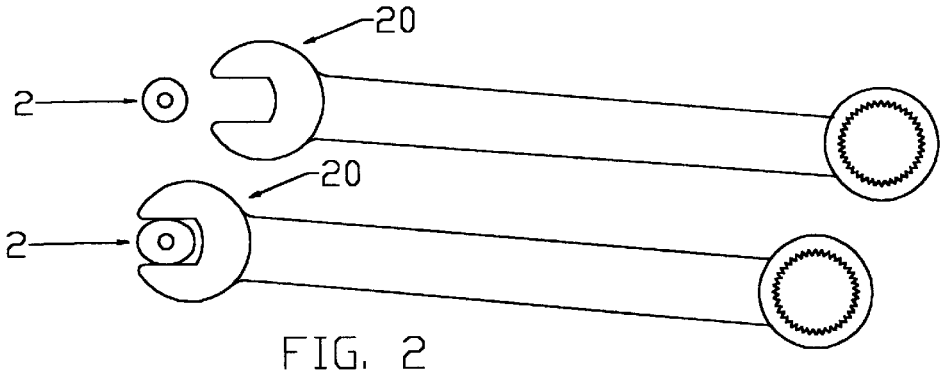
FIG. 2 is a side view illustrating the gripping property when a wrench is placed in operative engagement of the present invention.
Figure 4:
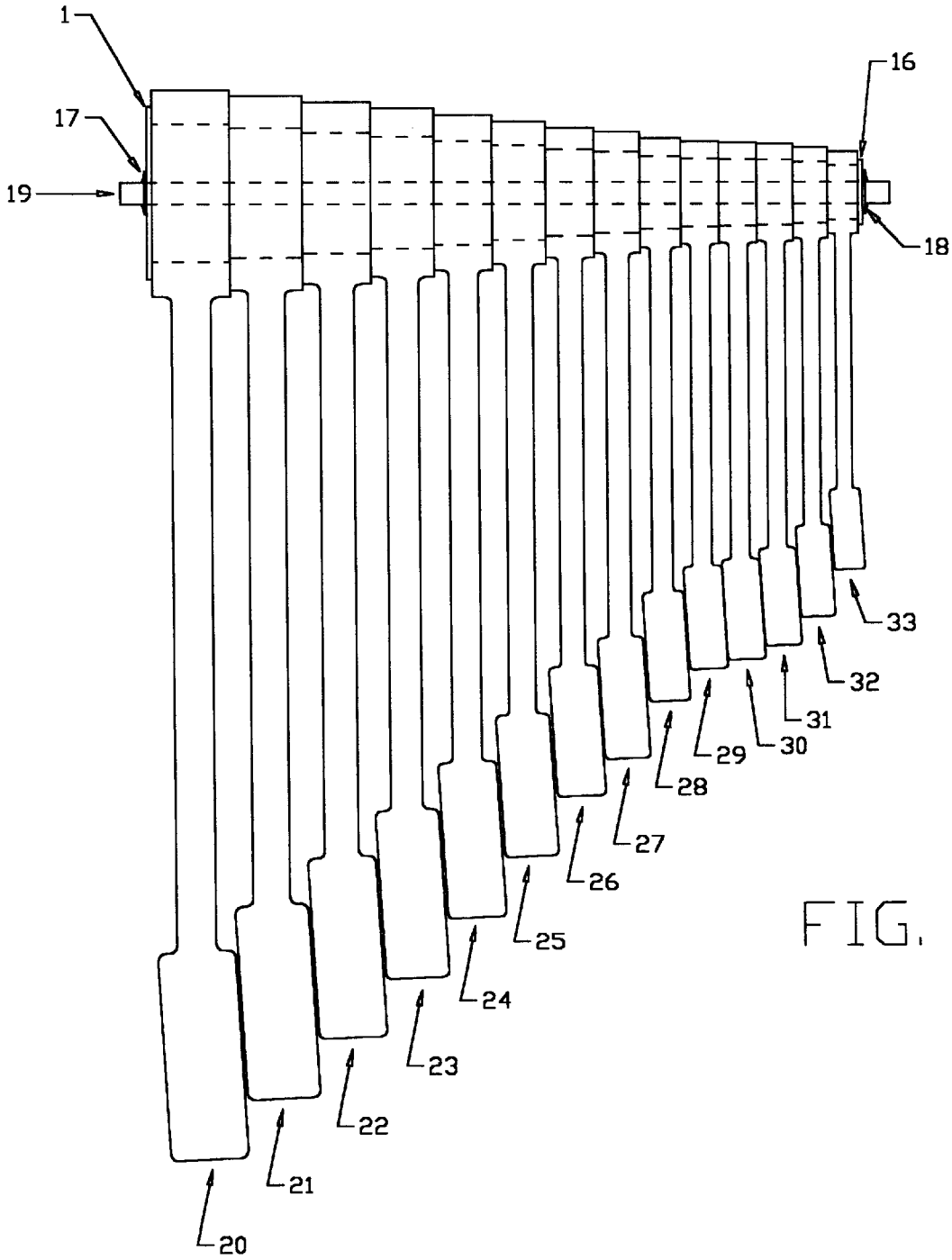
FIG. 4 is an elevational view illustrating a set of wrenches in operative engagement of the present invention.

As shown in FIG. 2 the outside diameter of each rubber washer 2 through 15 of FIG. 1, indicated generally as rubber washer 2, is slightly greater than the opening of a wrench 20 through 33 of FIG. 4, indicated generally as wrench 20, so that when the opening of wrench 20 is reasonably forced onto the rubber washer 2, the rubber washer 2 is compressed causing it to grip the inside surface of the opening of wrench 20, therefore holding wrench 20 in position on the invention.

Figure 3:
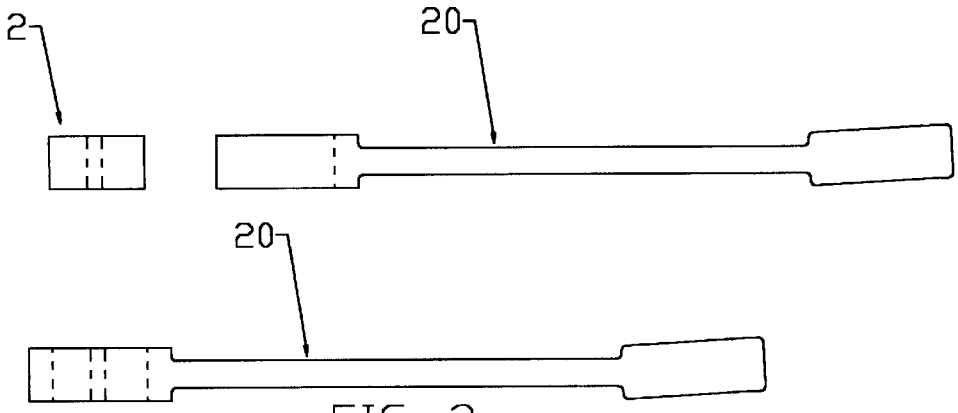
FIG. 3 is an elevational view of FIG. 2

As shown in FIG. 3 the thickness of the rubber washer 2 is substantially equal to the thickness of the head of wrench 20.

As shown in FIG. 4 a set of wrenches 20 through 33 can be seen in operative engagement of the present invention. The wrenches 20 through 33 are very compactly organized and the invention is substantially enclosed in the heads of wrenches 20 through 33. The only portion of the present invention visible in this view is the thin rigid washer 1, the thin rigid washer 16, the retainer 17, the retainer 18, and the outermost ends of the round support rod 19.

While the foregoing has presented a description of the preferred embodiment of the present invention, it is to be understood that changes in structure, materials, sizes and shapes can be made by those skilled in the art without departing from the spirit and scope of the invention as herein described and claimed.

I claim:

1. A compact organizer for a set of different sized open-end wrenches comprising: a support rod having first and second ends, said support rod extending through the respective centers of a first retainer, a first thin rigid washer, a plurality of progressively different sized rubber washers, a second thin rigid washer, and a second retainer, said first retainer proximate said first end and adapted to grip said support rod, said first thin rigid washer sized to form a stop for the largest wrench, of the set said rubber washers each having an outside diameter slightly larger than the opening of the head of a corresponding wrench, said rubber washers having a thickness substantially equal to the thickness of the head of a corresponding wrench, said rubber washers being compressible when reasonably forced into the opening of the head of a corresponding wrench, said second thin rigid washer sized to form a stop for the smallest wrench, of the set said second retainer proximate said second end and adapted to grip said support rod.

* * * * *